US008174469B2

(12) United States Patent
Moe et al.

(10) Patent No.: US 8,174,469 B2
(45) Date of Patent: May 8, 2012

(54) DYNAMIC DRIVER IC AND DISPLAY PANEL CONFIGURATION

(75) Inventors: Douglas H. Moe, Oceanside, CA (US); Franklin P. Antonio, Del Mar, CA (US); Richard A. Stewart, San Diego, CA (US)

(73) Assignee: Qualcomm MEMS Technologies, Inc., San Diego, CA (US)

( * ) Notice: Subject to any disclaimer, the term of this patent is extended or adjusted under 35 U.S.C. 154(b) by 1144 days.

(21) Appl. No.: 11/429,571

(22) Filed: May 5, 2006

(65) Prior Publication Data

US 2006/0279495 A1 Dec. 14, 2006

Related U.S. Application Data

(60) Provisional application No. 60/678,482, filed on May 5, 2005.

(51) Int. Cl.
*G09G 3/34* (2006.01)

(52) U.S. Cl. ..... 345/84; 345/87; 359/290

(58) Field of Classification Search ..... 345/84, 345/204

See application file for complete search history.

(56) References Cited

U.S. PATENT DOCUMENTS

| | | | |
|---|---|---|---|
| 3,982,239 | A | 9/1976 | Sherr |
| 4,403,248 | A | 9/1983 | te Velde |
| 4,441,791 | A | 4/1984 | Hornbeck |
| 4,459,182 | A | 7/1984 | te Velde |
| 4,482,213 | A | 11/1984 | Piliavin et al. |
| 4,500,171 | A | 2/1985 | Penz et al. |
| 4,519,676 | A | 5/1985 | te Velde |
| 4,566,935 | A | 1/1986 | Hornbeck |
| 4,571,603 | A | 2/1986 | Hornbeck et al. |
| 4,596,992 | A | 6/1986 | Hornbeck |
| 4,615,595 | A | 10/1986 | Hornbeck |
| 4,662,746 | A | 5/1987 | Hornbeck |
| 4,681,403 | A | 7/1987 | te Velde et al. |
| 4,709,995 | A | 12/1987 | Kuribayashi et al. |
| 4,710,732 | A | 12/1987 | Hornbeck |
| 4,856,863 | A | 8/1989 | Sampsell et al. |
| 4,859,060 | A | 8/1989 | Katagiri et al. |
| 4,954,789 | A | 9/1990 | Sampsell |
| 4,956,619 | A | 9/1990 | Hornbeck |
| 4,982,184 | A | 1/1991 | Kirkwood |
| 5,018,256 | A | 5/1991 | Hornbeck |

(Continued)

FOREIGN PATENT DOCUMENTS

EP 0295802 A 12/1988

(Continued)

OTHER PUBLICATIONS

Bains, "Digital Paper Display Technology holds Promise for Portables", CommsDesign EE Times (2000).

(Continued)

*Primary Examiner* — Alexander Eisen
*Assistant Examiner* — Kenneth B Lee, Jr.
(74) *Attorney, Agent, or Firm* — Knobbe Martens Olson & Bear LLP

(57) ABSTRACT

A display device which can provide configuration information to the driver circuit and methods of manufacturing and operating the same are disclosed. In one embodiment, a display device comprises a display array and a collection of links configured to store information related to the display array.

8 Claims, 12 Drawing Sheets

U.S. PATENT DOCUMENTS

| | | | |
|---|---|---|---|
| 5,028,939 | A | 7/1991 | Hornbeck et al. |
| 5,037,173 | A | 8/1991 | Sampsell et al. |
| 5,055,833 | A | 10/1991 | Hehlen et al. |
| 5,061,049 | A | 10/1991 | Hornbeck |
| 5,078,479 | A | 1/1992 | Vuilleumier |
| 5,079,544 | A | 1/1992 | DeMond et al. |
| 5,083,857 | A | 1/1992 | Hornbeck |
| 5,096,279 | A | 3/1992 | Hornbeck et al. |
| 5,099,353 | A | 3/1992 | Hornbeck |
| 5,124,834 | A | 6/1992 | Cusano et al. |
| 5,142,405 | A | 8/1992 | Hornbeck |
| 5,142,414 | A | 8/1992 | Koehler et al. |
| 5,162,787 | A | 11/1992 | Thompson et al. |
| 5,168,406 | A | 12/1992 | Nelson |
| 5,170,156 | A | 12/1992 | DeMond et al. |
| 5,172,262 | A | 12/1992 | Hornbeck |
| 5,179,274 | A | 1/1993 | Sampsell |
| 5,192,395 | A | 3/1993 | Boysel et al. |
| 5,192,946 | A | 3/1993 | Thompson et al. |
| 5,206,629 | A | 4/1993 | DeMond et al. |
| 5,212,582 | A | 5/1993 | Nelson |
| 5,214,419 | A | 5/1993 | DeMond et al. |
| 5,214,420 | A | 5/1993 | Thompson et al. |
| 5,216,537 | A | 6/1993 | Hornbeck |
| 5,226,099 | A | 7/1993 | Mignardi et al. |
| 5,227,900 | A | 7/1993 | Inaba et al. |
| 5,231,532 | A | 7/1993 | Magel et al. |
| 5,233,385 | A | 8/1993 | Sampsell |
| 5,233,456 | A | 8/1993 | Nelson |
| 5,233,459 | A | 8/1993 | Bozler et al. |
| 5,254,980 | A | 10/1993 | Hendrix et al. |
| 5,272,473 | A | 12/1993 | Thompson et al. |
| 5,278,652 | A | 1/1994 | Urbanus et al. |
| 5,280,277 | A | 1/1994 | Hornbeck |
| 5,287,096 | A | 2/1994 | Thompson et al. |
| 5,287,215 | A | 2/1994 | Warde et al. |
| 5,296,950 | A | 3/1994 | Lin et al. |
| 5,305,640 | A | 4/1994 | Boysel et al. |
| 5,312,513 | A | 5/1994 | Florence et al. |
| 5,323,002 | A | 6/1994 | Sampsell et al. |
| 5,325,116 | A | 6/1994 | Sampsell |
| 5,327,286 | A | 7/1994 | Sampsell et al. |
| 5,331,454 | A | 7/1994 | Hornbeck |
| 5,339,116 | A | 8/1994 | Urbanus et al. |
| 5,365,283 | A | 11/1994 | Doherty et al. |
| 5,396,593 | A | 3/1995 | Mori et al. |
| 5,411,769 | A | 5/1995 | Hornbeck |
| 5,444,566 | A | 8/1995 | Gale et al. |
| 5,446,479 | A | 8/1995 | Thompson et al. |
| 5,448,314 | A | 9/1995 | Heimbuch et al. |
| 5,452,024 | A | 9/1995 | Sampsell |
| 5,454,906 | A | 10/1995 | Baker et al. |
| 5,457,493 | A | 10/1995 | Leddy et al. |
| 5,457,566 | A | 10/1995 | Sampsell et al. |
| 5,459,602 | A | 10/1995 | Sampsell |
| 5,461,411 | A | 10/1995 | Florence et al. |
| 5,481,274 | A | 1/1996 | Aratani et al. |
| 5,483,260 | A | 1/1996 | Parks et al. |
| 5,488,505 | A | 1/1996 | Engle |
| 5,489,952 | A | 2/1996 | Gove et al. |
| 5,497,172 | A | 3/1996 | Doherty et al. |
| 5,497,197 | A | 3/1996 | Gove et al. |
| 5,499,062 | A | 3/1996 | Urbanus |
| 5,506,597 | A | 4/1996 | Thompson et al. |
| 5,515,076 | A | 5/1996 | Thompson et al. |
| 5,517,347 | A | 5/1996 | Sampsell |
| 5,523,803 | A | 6/1996 | Urbanus et al. |
| 5,526,051 | A | 6/1996 | Gove et al. |
| 5,526,172 | A | 6/1996 | Kanack |
| 5,526,688 | A | 6/1996 | Boysel et al. |
| 5,535,047 | A | 7/1996 | Hornbeck |
| 5,548,301 | A | 8/1996 | Kornher et al. |
| 5,551,293 | A | 9/1996 | Boysel et al. |
| 5,552,924 | A | 9/1996 | Tregilgas |
| 5,552,925 | A | 9/1996 | Worley |
| 5,563,398 | A | 10/1996 | Sampsell |
| 5,567,334 | A | 10/1996 | Baker et al. |
| 5,570,135 | A | 10/1996 | Gove et al. |
| 5,578,976 | A | 11/1996 | Yao |
| 5,581,272 | A | 12/1996 | Conner et al. |
| 5,583,688 | A | 12/1996 | Hornbeck |
| 5,589,852 | A | 12/1996 | Thompson et al. |
| 5,597,736 | A | 1/1997 | Sampsell |
| 5,598,565 | A | 1/1997 | Reinhardt |
| 5,600,383 | A | 2/1997 | Hornbeck |
| 5,602,671 | A | 2/1997 | Hornbeck |
| 5,606,441 | A | 2/1997 | Florence et al. |
| 5,608,468 | A | 3/1997 | Gove et al. |
| 5,610,438 | A | 3/1997 | Wallace et al. |
| 5,610,624 | A | 3/1997 | Bhuva |
| 5,610,625 | A | 3/1997 | Sampsell |
| 5,612,713 | A | 3/1997 | Bhuva et al. |
| 5,613,103 | A | 3/1997 | Nobutani et al. |
| 5,619,061 | A | 4/1997 | Goldsmith et al. |
| 5,619,365 | A | 4/1997 | Rhoades et al. |
| 5,619,366 | A | 4/1997 | Rhoads et al. |
| 5,629,790 | A | 5/1997 | Neukermans et al. |
| 5,633,652 | A | 5/1997 | Kanbe et al. |
| 5,636,052 | A | 6/1997 | Arney et al. |
| 5,638,084 | A | 6/1997 | Kalt |
| 5,638,946 | A | 6/1997 | Zavracky et al. |
| 5,646,768 | A | 7/1997 | Kaeiyama |
| 5,650,834 | A | 7/1997 | Nakagawa et al. |
| 5,650,881 | A | 7/1997 | Hornbeck |
| 5,654,741 | A | 8/1997 | Sampsell et al. |
| 5,657,099 | A | 8/1997 | Doherty et al. |
| 5,659,374 | A | 8/1997 | Gale, Jr. et al. |
| 5,665,997 | A | 9/1997 | Weaver et al. |
| 5,745,193 | A | 4/1998 | Urbanus et al. |
| 5,745,281 | A | 4/1998 | Yi et al. |
| 5,754,160 | A | 5/1998 | Shimizu et al. |
| 5,771,116 | A | 6/1998 | Miller et al. |
| 5,784,189 | A | 7/1998 | Bozler et al. |
| 5,784,212 | A | 7/1998 | Hornbeck |
| 5,808,780 | A | 9/1998 | McDonald |
| 5,818,095 | A | 10/1998 | Sampsell |
| 5,835,255 | A | 11/1998 | Miles |
| 5,842,088 | A | 11/1998 | Thompson |
| 5,867,302 | A | 2/1999 | Fleming et al. |
| 5,912,758 | A | 6/1999 | Knipe et al. |
| 5,943,158 | A | 8/1999 | Ford et al. |
| 5,959,763 | A | 9/1999 | Bozler et al. |
| 5,966,235 | A | 10/1999 | Walker et al. |
| 5,986,796 | A | 11/1999 | Miles |
| 6,028,690 | A | 2/2000 | Carter et al. |
| 6,038,056 | A | 3/2000 | Florence et al. |
| 6,040,937 | A | 3/2000 | Miles |
| 6,049,317 | A | 4/2000 | Thompson et al. |
| 6,055,090 | A | 4/2000 | Miles |
| 6,061,075 | A | 5/2000 | Nelson et al. |
| 6,099,132 | A | 8/2000 | Kaeriyama |
| 6,100,872 | A | 8/2000 | Aratani et al. |
| 6,113,239 | A | 9/2000 | Sampsell et al. |
| 6,147,790 | A | 11/2000 | Meier et al. |
| 6,160,833 | A | 12/2000 | Floyd et al. |
| 6,180,428 | B1 | 1/2001 | Peeters et al. |
| 6,201,633 | B1 | 3/2001 | Peeters et al. |
| 6,232,936 | B1 | 5/2001 | Gove et al. |
| 6,246,398 | B1 | 6/2001 | Koo |
| 6,275,326 | B1 | 8/2001 | Bhalla et al. |
| 6,282,010 | B1 | 8/2001 | Sulzbach et al. |
| 6,295,154 | B1 | 9/2001 | Laor et al. |
| 6,304,297 | B1 | 10/2001 | Swan |
| 6,323,982 | B1 | 11/2001 | Hornbeck |
| 6,327,071 | B1 | 12/2001 | Kimura |
| 6,356,085 | B1 | 3/2002 | Ryat et al. |
| 6,356,254 | B1 | 3/2002 | Kimura |
| 6,429,601 | B1 | 8/2002 | Friend et al. |
| 6,433,917 | B1 | 8/2002 | Mei et al. |
| 6,447,126 | B1 | 9/2002 | Hornbeck |
| 6,465,355 | B1 | 10/2002 | Horsley |
| 6,466,358 | B2 | 10/2002 | Tew |
| 6,466,486 | B2 | 10/2002 | Kawasumi |
| 6,473,274 | B1 | 10/2002 | Maimone et al. |
| 6,480,177 | B2 | 11/2002 | Doherty et al. |
| 6,496,122 | B2 | 12/2002 | Sampsell |
| 6,501,107 | B1 * | 12/2002 | Sinclair et al. ..... 257/209 |

| | | | |
|---|---|---|---|
| 6,507,330 | B1 | 1/2003 | Handschy et al. |
| 6,507,331 | B1 | 1/2003 | Schlangen et al. |
| 6,545,335 | B1 | 4/2003 | Chua et al. |
| 6,548,908 | B2 | 4/2003 | Chua et al. |
| 6,549,338 | B1 | 4/2003 | Wolverton et al. |
| 6,552,840 | B2 | 4/2003 | Knipe |
| 6,574,033 | B1 | 6/2003 | Chui et al. |
| 6,589,625 | B1 | 7/2003 | Kothari et al. |
| 6,593,934 | B1 | 7/2003 | Liaw et al. |
| 6,600,201 | B2 | 7/2003 | Hartwell et al. |
| 6,606,175 | B1 | 8/2003 | Sampsell et al. |
| 6,625,047 | B2 | 9/2003 | Coleman, Jr. |
| 6,630,786 | B2 | 10/2003 | Cummings et al. |
| 6,632,698 | B2 | 10/2003 | Ives |
| 6,643,069 | B2 | 11/2003 | Dewald |
| 6,650,455 | B2 | 11/2003 | Miles |
| 6,666,561 | B1 | 12/2003 | Blakley |
| 6,674,090 | B1 | 1/2004 | Chua et al. |
| 6,674,562 | B1 | 1/2004 | Miles |
| 6,680,792 | B2 | 1/2004 | Miles |
| 6,710,908 | B2 | 3/2004 | Miles et al. |
| 6,741,377 | B2 | 5/2004 | Miles |
| 6,741,384 | B1 | 5/2004 | Martin et al. |
| 6,741,503 | B1 | 5/2004 | Farris et al. |
| 6,747,785 | B2 | 6/2004 | Chen et al. |
| 6,750,876 | B1 | 6/2004 | Atsatt et al. |
| 6,762,873 | B1 | 7/2004 | Coker et al. |
| 6,775,174 | B2 | 8/2004 | Huffman et al. |
| 6,778,155 | B2 | 8/2004 | Doherty et al. |
| 6,781,643 | B1 | 8/2004 | Watanabe et al. |
| 6,787,384 | B2 | 9/2004 | Okumura |
| 6,787,438 | B1 | 9/2004 | Nelson |
| 6,788,520 | B1 | 9/2004 | Behin et al. |
| 6,794,119 | B2 | 9/2004 | Miles |
| 6,811,267 | B1 | 11/2004 | Allen et al. |
| 6,813,060 | B1 | 11/2004 | Garcia et al. |
| 6,819,469 | B1 | 11/2004 | Koba |
| 6,822,628 | B2 | 11/2004 | Dunphy et al. |
| 6,825,835 | B2 | 11/2004 | Sano et al. |
| 6,829,132 | B2 | 12/2004 | Martin et al. |
| 6,853,129 | B1 | 2/2005 | Cummings et al. |
| 6,855,610 | B2 | 2/2005 | Tung et al. |
| 6,859,218 | B1 | 2/2005 | Luman et al. |
| 6,861,277 | B1 | 3/2005 | Monroe et al. |
| 6,862,022 | B2 | 3/2005 | Slupe |
| 6,862,029 | B1 | 3/2005 | D'Souza et al. |
| 6,867,896 | B2 | 3/2005 | Miles |
| 6,870,581 | B2 | 3/2005 | Li et al. |
| 6,903,860 | B2 | 6/2005 | Ishii |
| 6,914,586 | B2 * | 7/2005 | Burkhardt ..... 345/87 |
| 7,123,216 | B1 | 10/2006 | Miles |
| 7,161,728 | B2 | 1/2007 | Sampsell et al. |
| 7,196,837 | B2 | 3/2007 | Sampsell et al. |
| 7,345,805 | B2 | 3/2008 | Chui |
| 2001/0003487 | A1 | 6/2001 | Miles |
| 2001/0034075 | A1 | 10/2001 | Onoya |
| 2001/0043171 | A1 | 11/2001 | Van Gorkom et al. |
| 2001/0046081 | A1 | 11/2001 | Hayashi et al. |
| 2001/0051014 | A1 | 12/2001 | Behin et al. |
| 2002/0000959 | A1 | 1/2002 | Colgan et al. |
| 2002/0005827 | A1 | 1/2002 | Kobayashi |
| 2002/0012159 | A1 | 1/2002 | Tew |
| 2002/0015215 | A1 | 2/2002 | Miles |
| 2002/0024711 | A1 | 2/2002 | Miles |
| 2002/0036304 | A1 | 3/2002 | Ehmke et al. |
| 2002/0050882 | A1 | 5/2002 | Hyman et al. |
| 2002/0054424 | A1 | 5/2002 | Miles |
| 2002/0075226 | A1 | 6/2002 | Lippincott |
| 2002/0075555 | A1 | 6/2002 | Miles |
| 2002/0093722 | A1 | 7/2002 | Chan et al. |
| 2002/0097133 | A1 | 7/2002 | Charvet et al. |
| 2002/0126364 | A1 | 9/2002 | Miles |
| 2002/0179421 | A1 | 12/2002 | Williams et al. |
| 2002/0186108 | A1 | 12/2002 | Hallbjorner |
| 2003/0004272 | A1 | 1/2003 | Power |
| 2003/0043157 | A1 | 3/2003 | Miles |
| 2003/0072070 | A1 | 4/2003 | Miles |
| 2003/0122773 | A1 | 7/2003 | Washio et al. |
| 2003/0137215 | A1 | 7/2003 | Cabuz |
| 2003/0137521 | A1 | 7/2003 | Zehner et al. |
| 2003/0189536 | A1 | 10/2003 | Ruigt |
| 2003/0202264 | A1 | 10/2003 | Weber et al. |
| 2003/0202265 | A1 | 10/2003 | Reboa et al. |
| 2003/0202266 | A1 | 10/2003 | Ring et al. |
| 2004/0008396 | A1 | 1/2004 | Stappaerts |
| 2004/0022044 | A1 | 2/2004 | Yasuoka et al. |
| 2004/0026757 | A1 | 2/2004 | Crane et al. |
| 2004/0027701 | A1 | 2/2004 | Ishikawa |
| 2004/0046920 | A1 | 3/2004 | Hayata et al. |
| 2004/0051929 | A1 | 3/2004 | Sampsell et al. |
| 2004/0058532 | A1 | 3/2004 | Miles et al. |
| 2004/0080807 | A1 | 4/2004 | Chen et al. |
| 2004/0145049 | A1 | 7/2004 | McKinnell et al. |
| 2004/0147056 | A1 | 7/2004 | McKinnell et al. |
| 2004/0160143 | A1 | 8/2004 | Shreeve et al. |
| 2004/0174583 | A1 | 9/2004 | Chen et al. |
| 2004/0179281 | A1 | 9/2004 | Reboa |
| 2004/0212026 | A1 | 10/2004 | Van Brocklin et al. |
| 2004/0217378 | A1 | 11/2004 | Martin et al. |
| 2004/0217919 | A1 | 11/2004 | Pichl et al. |
| 2004/0218251 | A1 | 11/2004 | Piehl et al. |
| 2004/0218334 | A1 | 11/2004 | Martin et al. |
| 2004/0218341 | A1 | 11/2004 | Martin et al. |
| 2004/0223204 | A1 | 11/2004 | Mao et al. |
| 2004/0227493 | A1 | 11/2004 | Van Brocklin et al. |
| 2004/0240032 | A1 | 12/2004 | Miles |
| 2004/0240138 | A1 | 12/2004 | Martin et al. |
| 2004/0245588 | A1 | 12/2004 | Nikkel et al. |
| 2004/0263944 | A1 | 12/2004 | Miles et al. |
| 2005/0001828 | A1 | 1/2005 | Martin et al. |
| 2005/0012577 | A1 | 1/2005 | Pillans et al. |
| 2005/0038950 | A1 | 2/2005 | Adelmann |
| 2005/0057442 | A1 | 3/2005 | Way |
| 2005/0068583 | A1 | 3/2005 | Gutkowski et al. |
| 2005/0069209 | A1 | 3/2005 | Damera-Venkata et al. |
| 2005/0116924 | A1 | 6/2005 | Sauvante et al. |
| 2005/0168431 | A1 | 8/2005 | Chui |
| 2005/0206991 | A1 * | 9/2005 | Chui et al. ..... 359/290 |
| 2005/0286113 | A1 | 12/2005 | Miles |
| 2005/0286114 | A1 | 12/2005 | Miles |
| 2006/0044246 | A1 | 3/2006 | Mignard |
| 2006/0044298 | A1 | 3/2006 | Mignard et al. |
| 2006/0044928 | A1 | 3/2006 | Chui et al. |
| 2006/0056000 | A1 | 3/2006 | Mignard |
| 2006/0057754 | A1 | 3/2006 | Cummings |
| 2006/0066542 | A1 | 3/2006 | Chui |
| 2006/0066553 | A1 | 3/2006 | Deane |
| 2006/0066559 | A1 | 3/2006 | Chui et al. |
| 2006/0066560 | A1 | 3/2006 | Gally et al. |
| 2006/0066561 | A1 | 3/2006 | Chui et al. |
| 2006/0066594 | A1 | 3/2006 | Tyger |
| 2006/0066597 | A1 | 3/2006 | Sampsell |
| 2006/0066598 | A1 | 3/2006 | Floyd |
| 2006/0066601 | A1 | 3/2006 | Kothari |
| 2006/0066935 | A1 | 3/2006 | Cummings et al. |
| 2006/0066937 | A1 | 3/2006 | Chui |
| 2006/0066938 | A1 | 3/2006 | Chui |
| 2006/0067648 | A1 | 3/2006 | Chui et al. |
| 2006/0067653 | A1 | 3/2006 | Gally et al. |
| 2006/0077127 | A1 | 4/2006 | Sampsell et al. |
| 2006/0077505 | A1 | 4/2006 | Chui et al. |
| 2006/0077520 | A1 | 4/2006 | Chui et al. |
| 2006/0103613 | A1 | 5/2006 | Chui |
| 2008/0158647 | A1 | 7/2008 | Chui |
| 2011/0095973 | A1 | 4/2011 | Chui |

FOREIGN PATENT DOCUMENTS

| | | | |
|---|---|---|---|
| EP | 0300754 | A2 | 1/1989 |
| EP | 0306308 | A2 | 3/1989 |
| EP | 0318050 | A | 5/1989 |
| EP | 0 417 523 | A | 3/1991 |
| EP | 0 467 048 | A | 1/1992 |
| EP | 0570906 | A | 11/1993 |
| EP | 0608056 | A1 | 7/1994 |
| EP | 0655725 | A1 | 5/1995 |
| EP | 0667548 | A1 | 8/1995 |
| EP | 0725380 | A1 | 8/1996 |
| EP | 0852371 | A1 | 7/1998 |

| | | | | |
|---|---|---|---|---|
| EP | 0911794 | A1 | | 4/1999 |
| EP | 0 017 038 | A | | 7/2000 |
| EP | 1146533 | A | | 10/2001 |
| EP | 1343190 | A | | 9/2003 |
| EP | 1345197 | A | | 9/2003 |
| EP | 1381023 | A | | 1/2004 |
| EP | 1473691 | A2 | | 11/2004 |
| GB | 2401200 | A | | 11/2004 |
| JP | 2002 175053 | | | 6/2002 |
| JP | 2004-29571 | | | 1/2004 |
| JP | 2004029571 | A | * | 1/2004 |
| JP | 2004 004553 | | | 8/2004 |
| WO | WO 95/30924 | | | 11/1995 |
| WO | WO 97/17628 | | | 5/1997 |
| WO | WO 99/52006 | A3 | | 10/1999 |
| WO | WO 01/73937 | A | | 10/2001 |
| WO | WO 03/007049 | A1 | | 1/2003 |
| WO | WO 03/015071 | A2 | | 2/2003 |
| WO | WO 03/044765 | A2 | | 5/2003 |
| WO | WO 03/060940 | A | | 7/2003 |
| WO | WO 03/069413 | A1 | | 8/2003 |
| WO | WO 03/073151 | A1 | | 9/2003 |
| WO | WO 03/079323 | A | | 9/2003 |
| WO | WO 03/090199 | A1 | | 10/2003 |
| WO | WO 2004/006003 | A1 | | 1/2004 |
| WO | WO 2004/026757 | A | | 4/2004 |
| WO | WO 2004/049034 | A1 | | 6/2004 |

OTHER PUBLICATIONS

Lieberman, "MEMS Display Looks to give PDAs Sharper Image" EE Times (2004).

Lieberman, "Microbridges at heart of new MEMS displays" EE Times (2004).

Peroulis et al., Low contact resistance series MEMS switches, 2002, pp. 223-226, vol. 1, IEEE MTT-S International Microwave Symposium Digest, New York, NY.

Seeger et al., "Stabilization of Electrostatically Actuated Mechanical Devices", (1997) International Conference on Solid State Sensors and Actuators; vol. 2, pp. 1133-1136.

Miles, MEMS-based interferometric modulator for display applications, Part of the SPIE Conference on Micromachined Devices and Components, vol. 3876, pp. 20-28 (1999).

Miles et al., 5.3: Digital Paper™: Reflective displays using interferometric modulation, SID Digest, vol. XXXI, 2000 pp. 32-35.

IPRP for PCT/US06/017232 filed May 4, 2006.

* cited by examiner

| | | Column Output Signals | |
|---|---|---|---|
| | | $+V_{bias}$ | $-V_{bias}$ |
| Row Output Signals | 0 | Stable | Stable |
| | $+\Delta V$ | Release | Actuate |
| | $-\Delta V$ | Actuate | Release |

DYNAMIC DRIVER IC AND DISPLAY PANEL CONFIGURATION

CROSS REFERENCE TO RELATED APPLICATIONS

This application claims priority under 35 U.S.C. Section 119(e) to U.S. Provisional Patent Applications 60/678,482 filed on May 5, 2005, which applications are hereby incorporated by reference in its entirety.

BACKGROUND OF THE INVENTION

1. Field of the Invention

The field of the invention relates to microelectromechanical systems (MEMS).

2. Description of the Related Technology

Microelectromechanical systems (MEMS) include micro mechanical elements, actuators, and electronics. Micromechanical elements may be created using deposition, etching, and/or other micromachining processes that etch away parts of substrates and/or deposited material layers or that add layers to form electrical and electromechanical devices. One type of MEMS device is called an interferometric modulator. As used herein, the term interferometric modulator or interferometric light modulator refers to a device that selectively absorbs and/or reflects light using the principles of optical interference. In certain embodiments, an interferometric modulator may comprise a pair of conductive plates, one or both of which may be transparent and/or reflective in whole or part and capable of relative motion upon application of an appropriate electrical signal. In a particular embodiment, one plate may comprise a stationary layer deposited on a substrate and the other plate may comprise a metallic membrane separated from the stationary layer by an air gap. As described herein in more detail, the position of one plate in relation to another can change the optical interference of light incident on the interferometric modulator. Such devices have a wide range of applications, and it would be beneficial in the art to utilize and/or modify the characteristics of these types of devices so that their features can be exploited in improving existing products and creating new products that have not yet been developed.

SUMMARY OF CERTAIN EMBODIMENTS

In one embodiment, a display device comprises a display array, and a collection of links configured to store information related to said display array.

In another embodiment, a display device comprises means for displaying image data, and means for encoding information related to said displaying means.

In another embodiment, a method of storing information related to a display array formed on a substrate comprises forming a collection of links on the substrate, wherein said information is encoded by forming each link as either an open circuit or a closed circuit between two ends of the link.

In another embodiment, a method of making a display device comprises forming a display array on a substrate, and forming a collection of links on the substrate, each link being formed as either an open circuit or a closed circuit between two ends of the link.

In another embodiment, a method of making a display device comprises forming a display array on a substrate, forming a collection of links on the substrate, the links being configured to store information related to the display array, connecting a configurable driver circuit to the collection of links, reading the information stored in the collection of links, and configuring the driver circuit based on information stored in the collection of links.

DETAILED DESCRIPTION OF THE CERTAIN EMBODIMENTS OF THE INVENTION

The following detailed description is directed to certain specific embodiments of the invention. However, the invention can be embodied in a multitude of different ways. In this description, reference is made to the drawings wherein like parts are designated with like numerals throughout. As will be apparent from the following description, the embodiments may be implemented in any device that is configured to display an image, whether in motion (e.g., video) or stationary (e.g., still image), and whether textual or pictorial. More particularly, it is contemplated that the embodiments may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Figure 1:
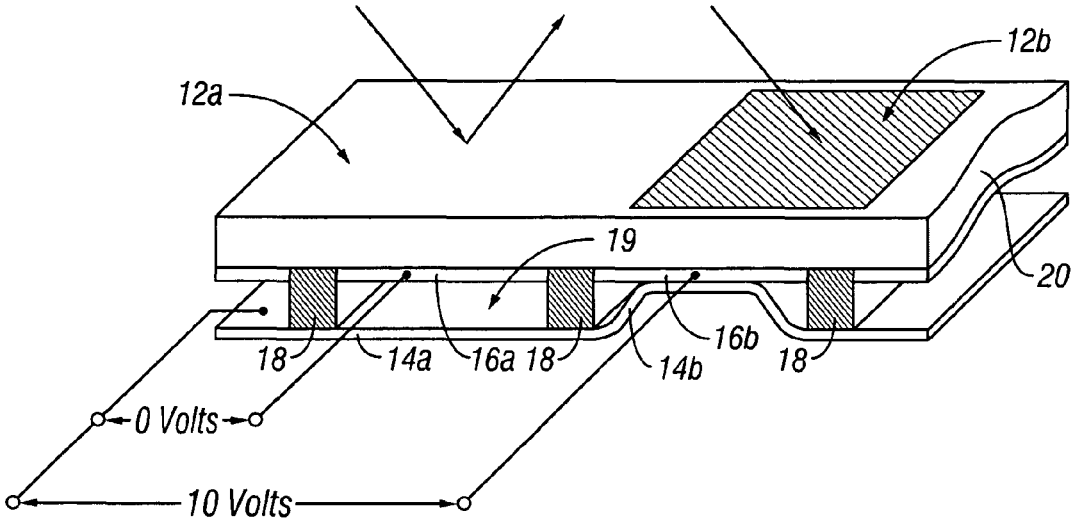
FIG. 1 is an isometric view depicting a portion of one embodiment of an interferometric modulator display in which a movable reflective layer of a first interferometric modulator is in a relaxed position and a movable reflective layer of a second interferometric modulator is in an actuated position.

One interferometric modulator display embodiment comprising an interferometric MEMS display element is illustrated in FIG. 1. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the relaxed position, the movable reflective layer is positioned at a relatively large distance from a fixed partially reflective layer. In the second position, referred to herein as the actuated position, the movable reflective layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable reflective layer 14*a* is illustrated in a relaxed position at a predetermined distance from an optical stack 16*a*, which includes a partially reflective layer. In the interferometric modulator 12*b* on the right, the movable reflective layer 14*b* is illustrated in an actuated position adjacent to the optical stack 16*b*.

The optical stacks 16*a* and 16*b* (collectively referred to as optical stack 16), as referenced herein, typically comprise several fused layers, which can include an electrode layer, such as indium tin oxide (ITO), a partially reflective layer, such as chromium, and a transparent dielectric. The optical stack 16 is thus electrically conductive, partially transparent, and partially reflective, and may be fabricated, for example, by depositing one or more of the above layers onto a transparent substrate 20. The partially reflective layer can be formed of one or more layers of materials, and each of the layers can be formed of a single material or a combination of materials.

In some embodiments, the layers of the optical stack 16 are patterned into parallel strips, and may form row electrodes in a display device as described further below. The movable reflective layers 14*a*, 14*b* may be formed as a series of parallel strips of a deposited metal layer or layers (orthogonal to the row electrodes of 16*a*, 16*b*) deposited on top of posts 18 and an intervening sacrificial material deposited between the posts 18. When the sacrificial material is etched away, the movable reflective layers 14*a*, 14*b* are separated from the optical stacks 16*a*, 16*b* by a defined gap 19. A highly conductive and reflective material such as aluminum may be used for the reflective layers 14, and these strips may form column electrodes in a display device.

With no applied voltage, the cavity 19 remains between the movable reflective layer 14*a* and optical stack 16*a*, with the movable reflective layer 14*a* in a mechanically relaxed state, as illustrated by the pixel 12*a* in FIG. 1. However, when a potential difference is applied to a selected row and column, the capacitor formed at the intersection of the row and column electrodes at the corresponding pixel becomes charged, and electrostatic forces pull the electrodes together. If the voltage is high enough, the movable reflective layer 14 is deformed and is forced against the optical stack 16. A dielectric layer (not illustrated in this Figure) within the optical stack 16 may prevent shorting and control the separation distance between layers 14 and 16, as illustrated by pixel 12*b* on the right in FIG. 1. The behavior is the same regardless of the polarity of the applied potential difference. In this way, row/column actuation that can control the reflective vs. non-reflective pixel states is analogous in many ways to that used in conventional LCD and other display technologies.

FIGS. 2 through 5B illustrate one exemplary process and system for using an array of interferometric modulators in a display application.

Figure 2:
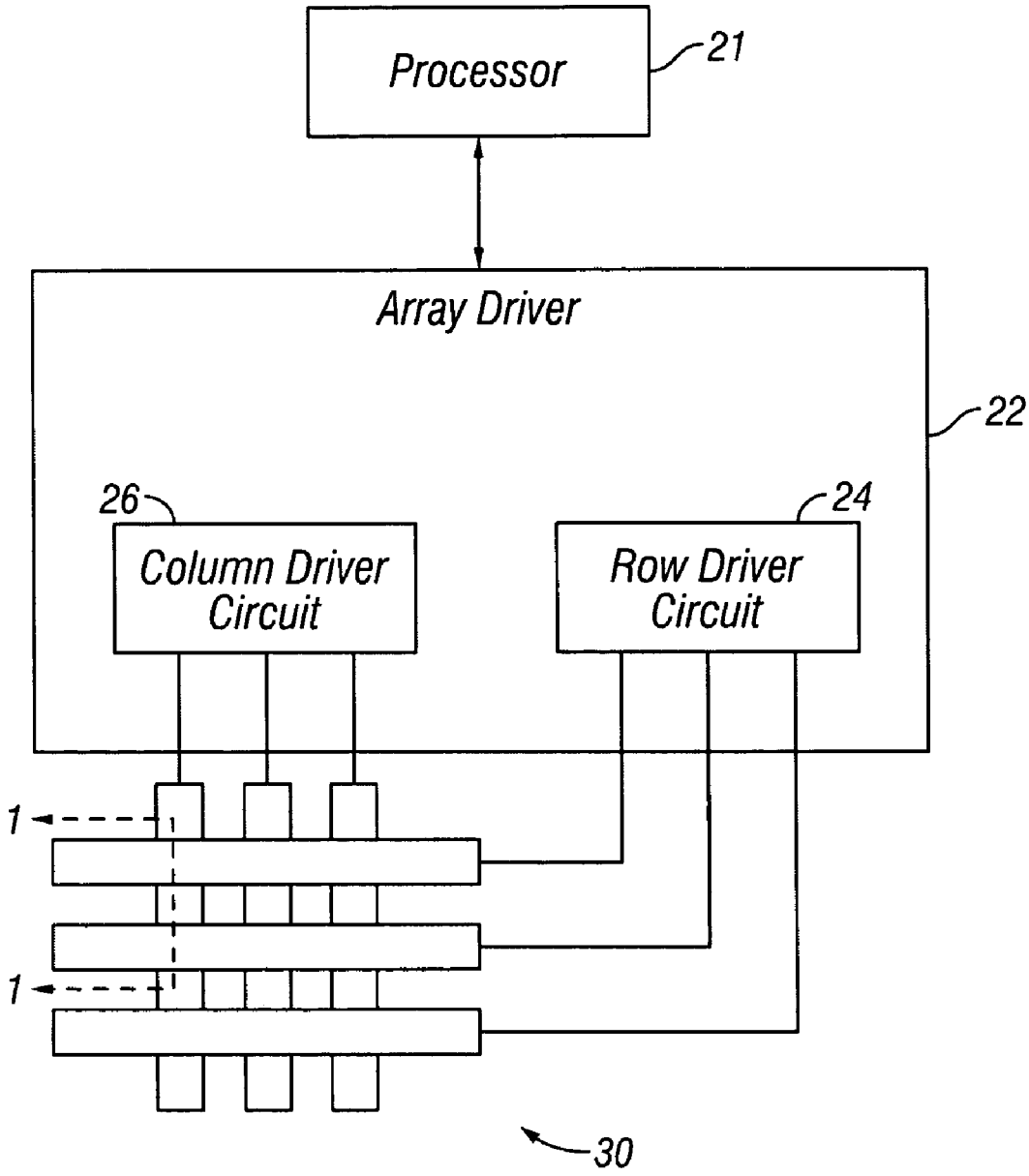
FIG. 2 is a system block diagram illustrating one embodiment of an electronic device incorporating a 3×3 interferometric modulator display.

FIG. 2 is a system block diagram illustrating one embodiment of an electronic device that may incorporate aspects of the invention. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array driver 22. In one embodiment, the array driver 22 includes a row driver circuit 24 and a column driver circuit 26 that provide signals to a display array or panel 30. The cross section of the array illustrated in FIG. 1 is shown by the lines 1-1 in FIG. 2. For MEMS interferometric modulators, the row/column actuation protocol may take advantage of a hysteresis property of these devices illustrated in FIG. 3. It may require, for example, a 10 volt potential difference to cause a movable layer to deform from the relaxed state to the actuated state. However, when the voltage is reduced from that value, the movable layer maintains its state as the voltage drops back below 10 volts. In the exemplary embodiment of FIG. 3, the movable layer does not relax completely until the voltage drops below 2 volts. Thus, there exists a window of applied voltage, about 3 to 7 V in the example illustrated in FIG. 3, within which the device is stable in either the relaxed or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 10 volts, and pixels that are to be relaxed are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new display data by continually repeating this process at some desired number of frames per second. A wide variety of protocols for driving row and column electrodes of pixel arrays to produce display frames are also well known and may be used in conjunction with the present invention.

Figures 3, 4:
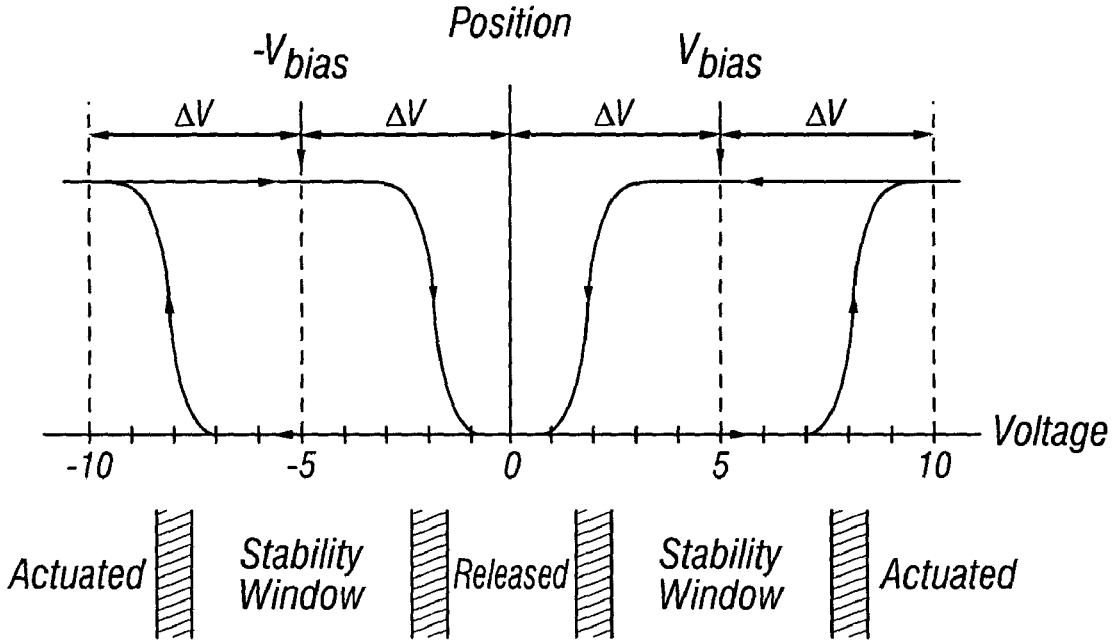
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display.
Figure 5A:
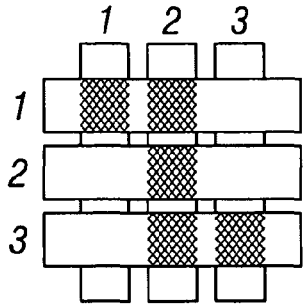
FIG. 5A illustrates one exemplary frame of display data in the 3×3 interferometric modulator display of FIG. 2.
Figure 5B:
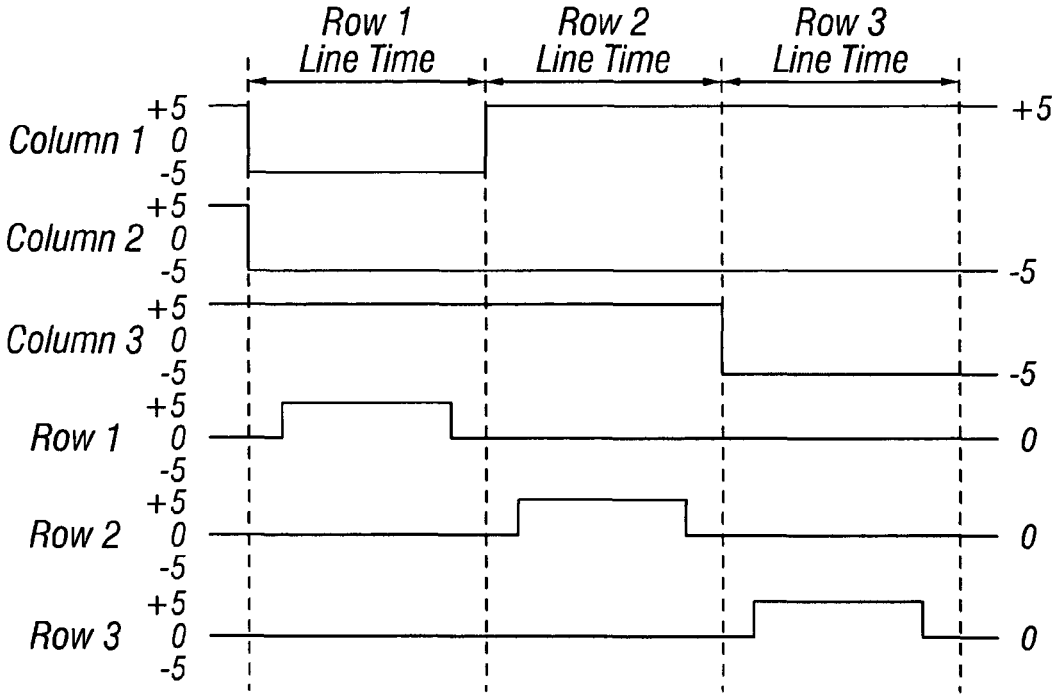
FIG. 5B illustrates one exemplary timing diagram for row and column signals that may be used to write the frame of FIG. 5A.

FIGS. 4, 5A, and 5B illustrate one possible actuation protocol for creating a display frame on the 3×3 array of FIG. 2. FIG. 4 illustrates a possible set of column and row voltage levels that may be used for pixels exhibiting the hysteresis curves of FIG. 3. In the FIG. 4 embodiment, actuating a pixel involves setting the appropriate column to $-V_{bias}$, and the appropriate row to $+\Delta V$, which may correspond to −5 volts and +5 volts, respectively Relaxing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. As is also illustrated in FIG. 4, it will be appreciated that voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

FIG. 5B is a timing diagram showing a series of row and column signals applied to the 3×3 array of FIG. 2 which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or relaxed states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and relaxes the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and relax pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used with the systems and methods described herein.

Figure 6A:
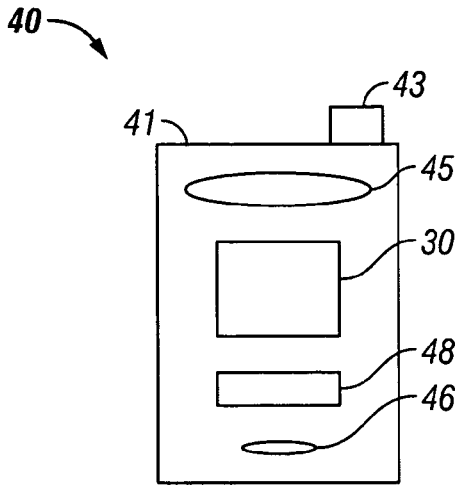
FIGS. 6A and 6B are system block diagrams illustrating an embodiment of a visual display device comprising a plurality of interferometric modulators.
Figure 6B:
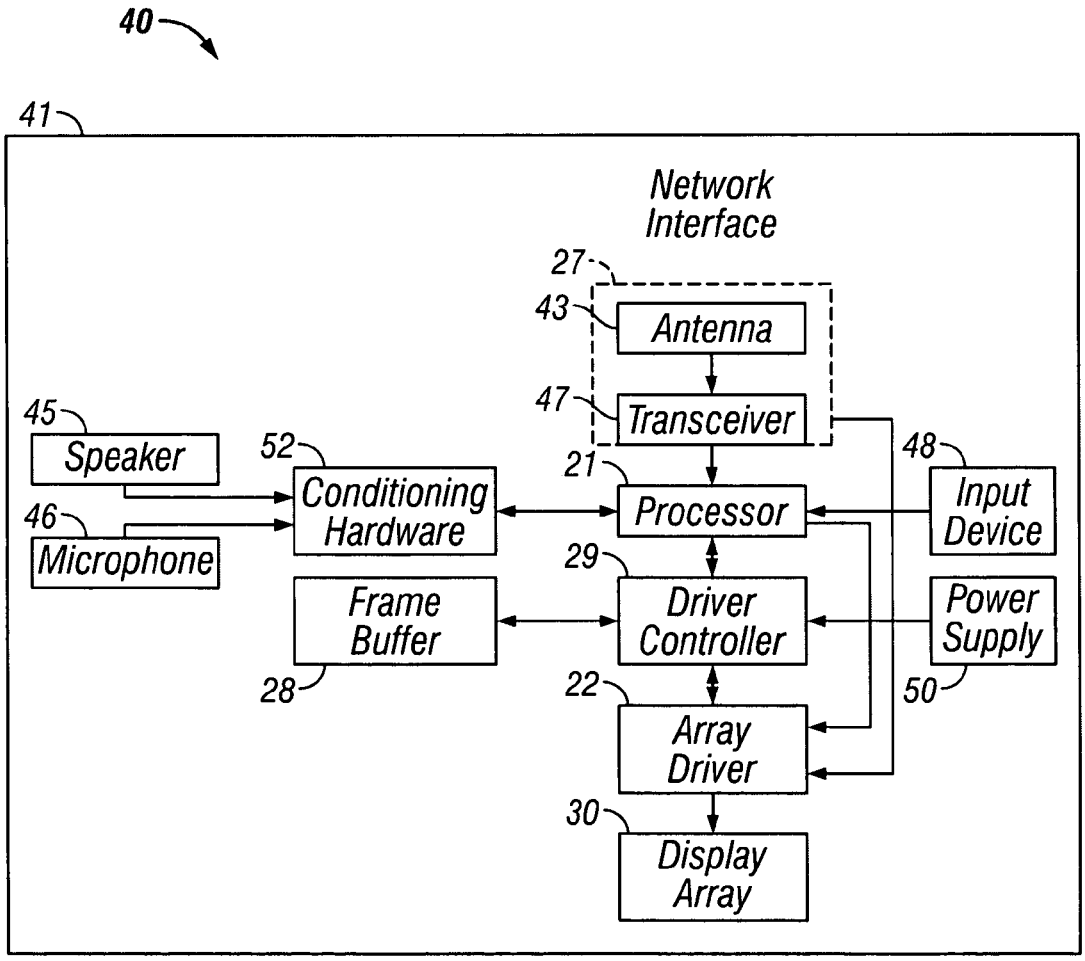

FIGS. 6A and 6B are system block diagrams illustrating an embodiment of a display device 40. The display device 40 can be, for example, a cellular or mobile telephone. However, the same components of display device 40 or slight variations thereof are also illustrative of various types of display devices such as televisions and portable media players.

The display device 40 includes a housing 41, a display 30, an antenna 43, a speaker 45, an input device 48, and a microphone 46. The housing 41 is generally formed from any of a variety of manufacturing processes as are well known to those of skill in the art, including injection molding and vacuum forming. In addition, the housing 41 may be made from any of a variety of materials, +including, but not limited to, plastic, metal, glass, rubber, and ceramic, or a combination thereof. In one embodiment, the housing 41 includes removable portions (not shown) that may be interchanged with other removable portions of different color, or containing different logos, pictures, or symbols.

The display 30 of exemplary display device 40 may be any of a variety of displays, including a bi-stable display, as described herein. In other embodiments, the display 30 includes a flat-panel display, such as plasma, EL, OLED, STN LCD, or TFT LCD as described above, or a non-flat-panel display, such as a CRT or other tube device, as is well known to those of skill in the art. However, for purposes of describing the present embodiment, the display 30 includes an interferometric modulator display, as described herein.

The components of one embodiment of exemplary display device 40 are schematically illustrated in FIG. 6B. The illustrated exemplary display device 40 includes a housing 41 and can include additional components at least partially enclosed therein. For example, in one embodiment, the exemplary display device 40 includes a network interface 27 that includes an antenna 43, which is coupled to a transceiver 47. The transceiver 47 is connected to a processor 21, which is connected to conditioning hardware 52. The conditioning hardware 52 may be configured to condition a signal (e.g., filter a signal). The conditioning hardware 52 is connected to a speaker 45 and a microphone 46. The processor 21 is also connected to an input device 48 and a driver controller 29. The driver controller 29 is coupled to a frame buffer 28 and to an array driver 22, which in turn is coupled to a display array 30. A power supply 50 provides power to all components as required by the particular exemplary display device 40 design.

The network interface 27 includes the antenna 43 and the transceiver 47 so that the exemplary display device 40 can communicate with one or more devices over a network. In one embodiment, the network interface 27 may also have some processing capabilities to relieve requirements of the processor 21. The antenna 43 is any antenna known to those of skill in the art for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS, or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the exemplary display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the exemplary display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and gray-scale level.

In one embodiment, the processor 21 includes a microcontroller, CPU, or logic unit to control operation of the exemplary display device 40. Conditioning hardware 52 generally includes amplifiers and filters for transmitting signals to the speaker 45, and for receiving signals from the microphone 46. Conditioning hardware 52 may be discrete components within the exemplary display device 40, or may be incorporated within the processor 21 or other components.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In one embodiment, a driver controller 29 is integrated with the array driver 22. Such an embodiment is common in highly integrated systems such as cellular phones, watches, and other small area displays. In yet another embodiment, display array 30 is a typical display array or a bi-stable display array (e.g., a display including an array of interferometric modulators).

The input device 48 allows a user to control the operation of the exemplary display device 40. In one embodiment, input device 48 includes a keypad, such as a QWERTY keyboard or a telephone keypad, a button, a switch, a touch-sensitive screen, or a pressure- or heat-sensitive membrane. In one embodiment, the microphone 46 is an input device for the exemplary display device 40. When the microphone 46 is used to input data to the device, voice commands may be provided by a user for controlling operations of the exemplary display device 40.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell including a plastic solar cell, and solar-cell paint. In another embodiment, power supply 50 is configured to receive power from a wall outlet.

In some embodiments, control programmability resides, as described above, in a driver controller which can be located in several places in the electronic display system. In some embodiments, control programmability resides in the array driver 22. Those of skill in the art will recognize that the above-described optimizations may be implemented in any number of hardware and/or software components and in various configurations.

Figure 7A:
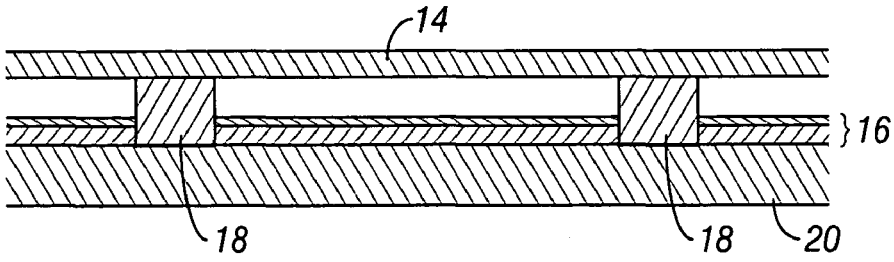
FIG. 7A is a cross section of the device of FIG. 1.
Figure 7B:
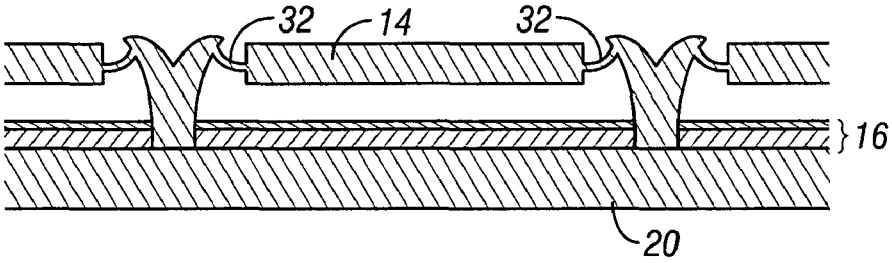
FIG. 7B is a cross section of an alternative embodiment of an interferometric modulator.
Figure 7C:
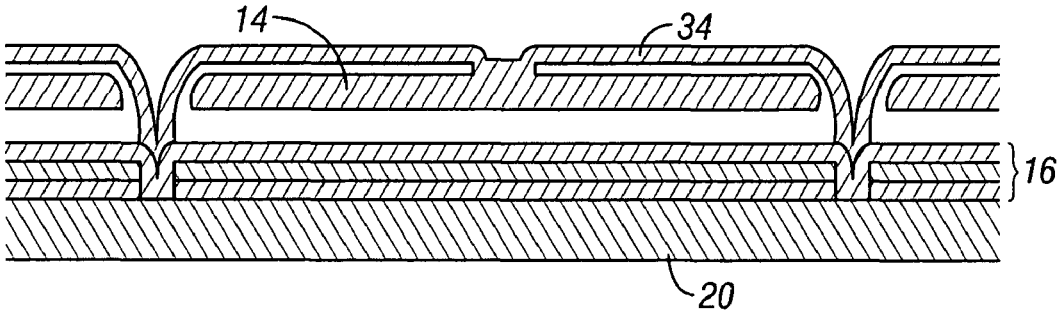
FIG. 7C is a cross section of another alternative embodiment of an interferometric modulator.
Figure 7D:
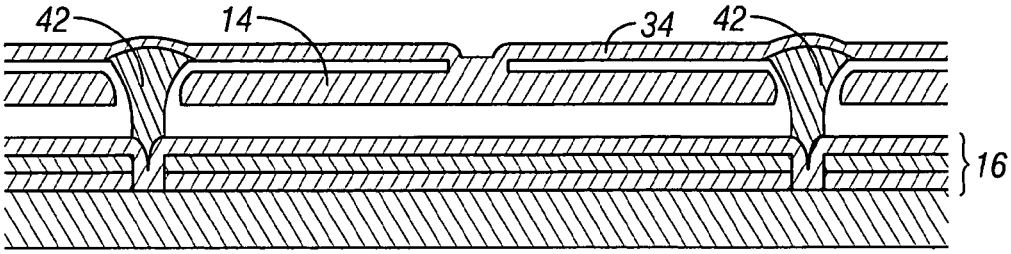
FIG. 7D is a cross section of yet another alternative embodiment of an interferometric modulator.
Figure 7E:
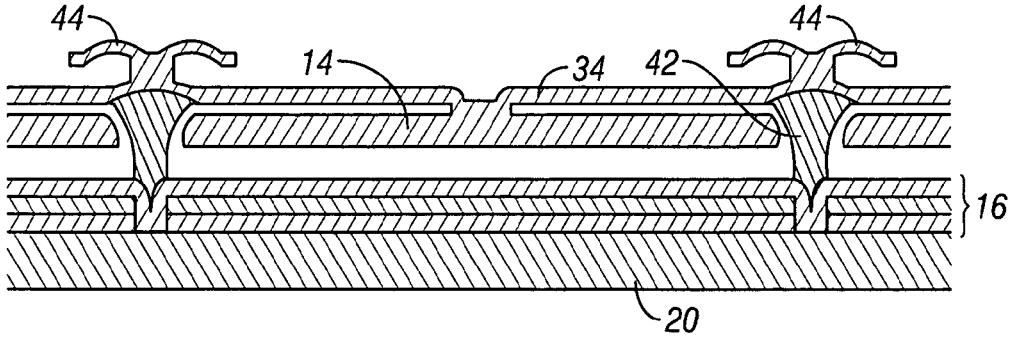
FIG. 7E is a cross section of an additional alternative embodiment of an interferometric modulator.

The details of the structure of interferometric modulators that operate in accordance with the principles set forth above may vary widely. For example, FIGS. 7A-7E illustrate five different embodiments of the movable reflective layer 14 and its supporting structures. FIG. 7A is a cross section of the embodiment of FIG. 1, where a strip of metal material 14 is deposited on orthogonally extending supports 18. In FIG. 7B, the moveable reflective layer 14 is attached to supports at the corners only, on tethers 32. In FIG. 7C, the moveable reflective layer 14 is suspended from a deformable layer 34, which may comprise a flexible metal. The deformable layer 34 connects, directly or indirectly, to the substrate 20 around the perimeter of the deformable layer 34. These connections are herein referred to as support posts. The embodiment illustrated in FIG. 7D has support post plugs 42 upon which the deformable layer 34 rests. The movable reflective layer 14 remains suspended over the cavity, as in FIGS. 7A-7C, but the deformable layer 34 does not form the support posts by filling holes between the deformable layer 34 and the optical stack 16. Rather, the support posts are formed of a planarization material, which is used to form support post plugs 42. The embodiment illustrated in FIG. 7E is based on the embodiment shown in FIG. 7D, but may also be adapted to work with any of the embodiments illustrated in FIGS. 7A-7C, as well as additional embodiments not shown. In the embodiment shown in FIG. 7E, an extra layer of metal or other conductive material has been used to form a bus structure 44. This allows signal routing along the back of the interferometric modulators, eliminating a number of electrodes that may otherwise have had to be formed on the substrate 20.

In embodiments such as those shown in FIG. 7, the interferometric modulators function as direct-view devices, in which images are viewed from the front side of the transparent substrate 20, the side opposite to that upon which the modulator is arranged. In these embodiments, the reflective layer 14 optically shields the portions of the interferometric modulator on the side of the reflective layer opposite the substrate 20, including the deformable layer 34. This allows the shielded areas to be configured and operated upon without negatively affecting the image quality. Such shielding allows the bus structure 44 in FIG. 7E, which provides the ability to separate the optical properties of the modulator from the electromechanical properties of the modulator, such as addressing and the movements that result from that addressing. This separable modulator architecture allows the structural design and materials used for the electromechanical aspects and the optical aspects of the modulator to be selected and to function independently of each other. Moreover, the embodiments shown in FIGS. 7C-7E have additional benefits deriving from the decoupling of the optical properties of the reflective layer 14 from its mechanical properties, which are carried out by the deformable layer 34. This allows the structural design and materials used for the reflective layer 14 to be optimized with respect to the optical properties, and the structural design and materials used for the deformable layer 34 to be optimized with respect to desired mechanical properties.

In certain display applications, there are a variety of parameters in the array driver that need to be configured before the array driver can reliably drive a display panel such as an iMoD panel. Failure to properly configure these parameters could cause a display device to fail. For example, pixels may not change state properly in response to driving signals. Such failure could appear a week, a month or a year after shipment of the display modules. To reduce the likelihood that customers or the module assembly facility improperly programs crucial parameters, a method of reliably and permanently establishing default parameters is needed.

One method of establishing default parameters may also satisfy several additional conditions. First, the display panel need not retain all of the configuration programming information required by the driver because it may be too costly to do so. Second, the method may support display panels of different types, such as display panels manufactured by different processes or manufactured with the same process under different parameters. In certain applications, the method needs only to support a small amount of information, for example, four bits of information will often be sufficient.

Certain embodiments described below provide a method of reliably and permanently encoding information which may satisfy all these requirements described.

Figure 8:
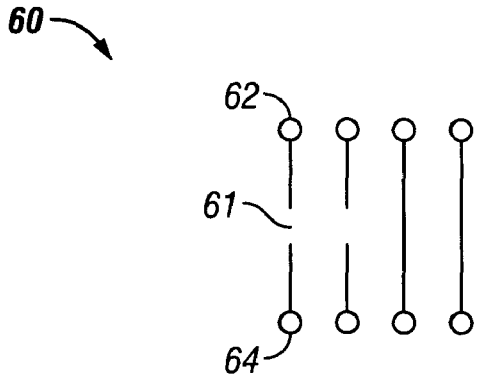
FIG. 8 is a schematic diagram illustrating one embodiment of a circuit that may be formed to store data.

FIG. 8 is a schematic diagram illustrating one embodiment of a circuit that may be formed to store data. In the exemplary embodiment, the circuit 60 comprises a collection of one or more links 61. Each link 61 can be in one of two states. In one state, a link 61 forms an open circuit between its two ends 62 and 64. In the other state, a link 61 forms a closed circuit between both ends. The state of each link 61, therefore, provides a bit of information.

Various schemes can be applied to store information in the circuit 60. In one embodiment, each link 61 of the circuit 60 provides a bit of information. A circuit 60 comprising four links 61, for example, can then provide 4 bits of information. In another embodiment, the number of links 61 in the circuit 60 which are open is used to provide information.

Various schemes can be applied to enable an electrical device to read the information stored in the circuit 60. In one embodiment, each end of each link 60 is connected to a separate contact pad (not shown). An electrical device, such as a driver chip, can be mounted onto the circuit 60 such that contact leads of the electrical device connect to each contact pad of each link. The electrical device detects the open and closed state of each link 61 and therefore reads the information stored in the circuit 60.

In another embodiment, one end of each link 61 is connected to a separate contact pad while the other end of each link 61 is connected to a common contact pad. Contact leads of an electrical device connect to each contact pad. The electrical device can apply a voltage signal, such as ground, to the common contact pad and sense the potential at other contact pads to detect the open and closed state of each link 61.

In still another embodiment, one end of each link 61 is connected to a separate contact pad while the other end of each link 61 is connected to a constant voltage such as ground. Contact leads of the electrical device connect to each contact pad. The electrical device reads the signal at the contact pad of each link 61 to detect the open and closed state of that link 61.

Figure 9A:
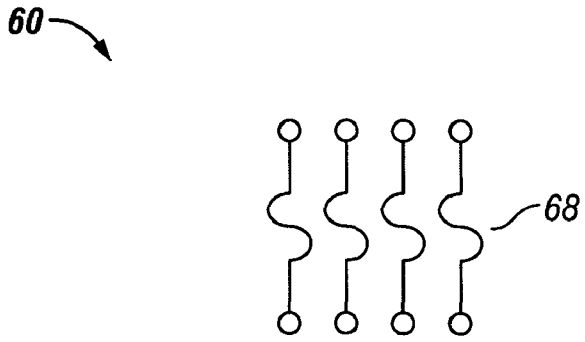
FIGS. 9A and 9B illustrate an embodiment of a method of forming the circuit 60 in FIG. 8 to store certain information.
Figure 9B:
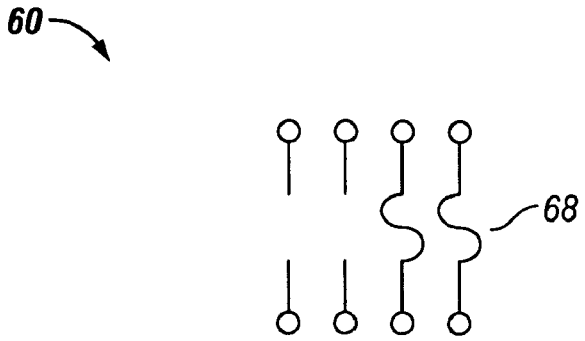

FIGS. 9A and 9B illustrate an embodiment of a method of forming the circuit 60 in FIG. 8 to store certain information. FIG. 9A shows a circuit 60 formed before the information is stored. Each link comprises a blowable fuse 68 connected between both ends of the link and therefore each link is in a closed circuit state.

The circuit 60 in FIG. 9A is then configured to store the information by selectively blowing certain blowable fuses in the circuit 60 in FIG. 9A. The resulting circuit 60 is shown in FIG. 9B. Blowable fuses are selectively blown such that each link in FIG. 9B encodes a bit of information.

Other methods are also available to form the circuit 60 in FIG. 8. In certain embodiments, each link 61 may comprise a circuit trace, or a highly conductive metal line such as a copper or aluminum line. In one embodiment, the metal line can be formed as a single and continuous line or a broken line segment, depending on the state of the link. In another embodiment, the circuit 60 is first formed wherein each link comprises a single continuous metal line. These metal lines are then selectively cut or separated corresponding to the information to be stored. The cutting or separating can be conducted through various processes including, for example, etching, cutting with a saw, and laser cutting.

The circuit 60 discussed above with regard to FIGS. 8, 9A, and 9B can be used in various applications to store information as needed. In certain embodiments, the circuit 60 is used to assist configuration of a driver circuit such that the driver circuit can provide proper driving signals to a display array. In these embodiments, a display array is first formed on a substrate. The circuit 60 is then formed on the substrate and configured to store information related to a display array, such as the type of the display array. A test device then reads information stored in the circuit 60 and configures an array driver based on such information. Alternatively, the circuit 60 may be formed in parallel with the display array. These embodiments are described in further detail below in FIGS. 10-14.

Figure 10:
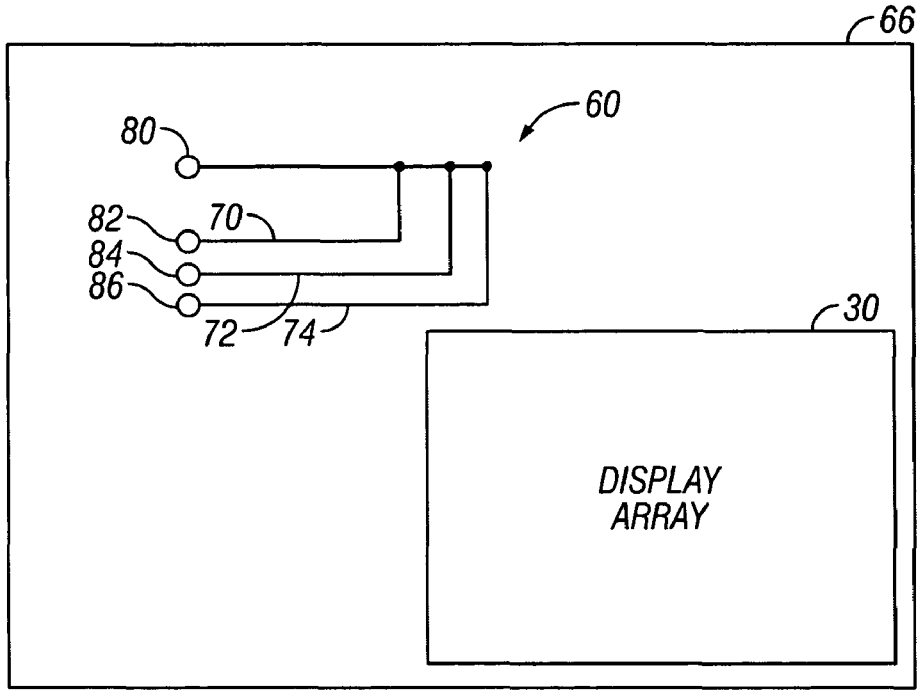
FIG. 10 is a schematic block diagram illustrating one embodiment of a display panel comprising a display array and a circuit configurable to store information on the display array.

FIG. 10 is a schematic block diagram illustrating one embodiment of a display panel comprising a display array and a circuit configurable to store information on the display array. The electronic device comprises a display array 30, which may advantageously be a MEMS array as described above in FIGS. 2 and 6B, although the display array 30 may be any of a variety of displays. In one embodiment, the display array 30 is formed on a substrate 66, such as a glass substrate.

The electronic device further comprises a circuit 60 similar to the circuit 60 discussed above with regard to FIGS. 9A and 9B. The circuit 60 is formed without encoding any information, but may be configured later to store certain information related to the display such as the type of the display array 30. The circuit 60 may comprise any number of links depending on the amount of information to be stored. In the exemplary embodiment, the circuit 60 comprises a collection of links 70, 72, and 74, wherein each link is in a closed circuit state. One end of the links 70, 72, and 74 is connected to contact pads 82, 84, and 86 respectively, while the other end is connected to a common contact pad 80.

The circuit 60 may be formed on the same substrate 66 on which the display array 30 is formed. In one embodiment, the circuit 60 is formed on the periphery of the display array 30. The circuit 60 and the display array 30 may or may not be formed in parallel.

Figure 11:
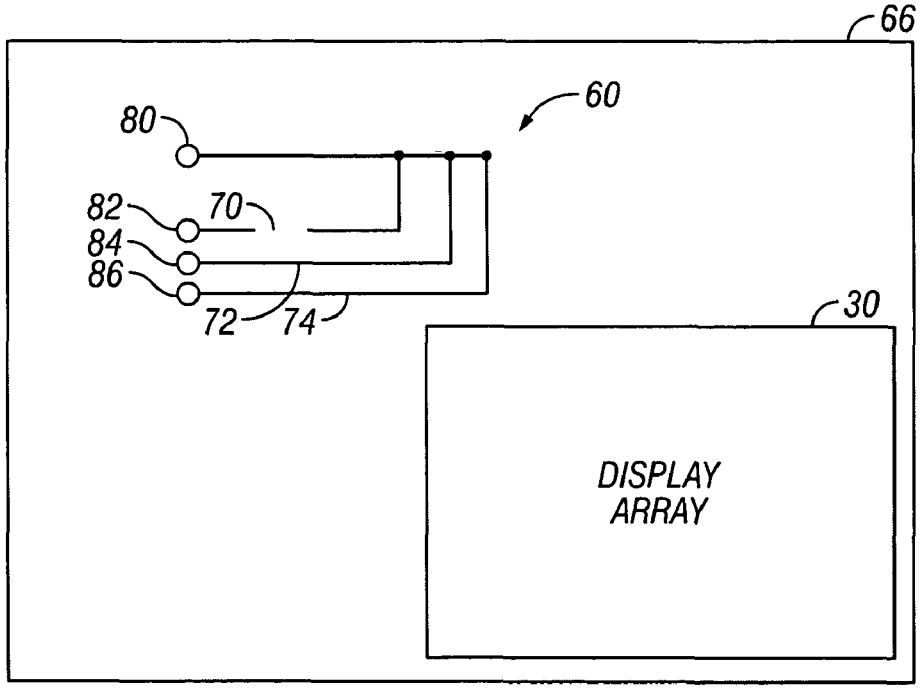
FIG. 11 is a schematic block diagram illustrating one embodiment of a display panel comprising a display array and a circuit storing information on the display array.

FIG. 11 is a schematic block diagram illustrating one embodiment of a display panel comprising a display array and a circuit storing information on the display array. The electronic device in FIG. 11 is similar to FIG. 10, except that the circuit 60 here stores information related to the display array 30. The link 70 is in an open circuit state while the links 72 and 74 are in a closed circuit state.

Various type of information can be stored in the circuit 60. The information may include, for example, one or more of the following: voltage driving level, operational current level, pixel count, drive schemes, display type, color or monochrome display, shape of display (e.g. portrait vs. landscape). In another embodiment, the information forms a panel identification number which defines a set of display parameters indirectly. An electronic device mounted to the circuit 60 may then read this identification number and retrieve the set of parameters corresponding to the panel identification number. This embodiment may be desirable when storing configuration parameters directly in the circuit 60 would require an unduly large number of information bits.

As discussed above with regard to FIGS. 9A and 9B, there are various ways to form the circuit 60 as shown in FIG. 11. In the exemplary embodiment, the circuit 60 as shown in FIG. 10 is first formed, wherein each link comprises a single continuous metal line. The circuit 60 in FIG. 10 is then modified to form the circuit as shown in FIG. 11, by selectively separating or cutting these metal lines based on the information to be stored.

In another embodiment, the circuit 60 as shown in FIG. 10 is first formed, wherein each link comprises a single continuous metal line. The circuit 60 in FIG. 10 is then modified to form the circuit as shown in FIG. 11, by selectively blowing these blowable fuses based on the information to be stored.

In still another embodiment, the circuit 60 is originally formed as shown in FIG. 11. Each link is formed as a single and continuous line or a broken line segment, depending on the information to be stored.

In the exemplary embodiment, one end of the links 70, 72, and 74 is connected to a common contact pad 80. Other embodiments are also available as discussed above with regard to FIG. 8. For example, one end of the links 70, 72, and 74 can be connected to a common voltage signal such as ground, instead of connecting to the contact pad 80.

Figure 12:
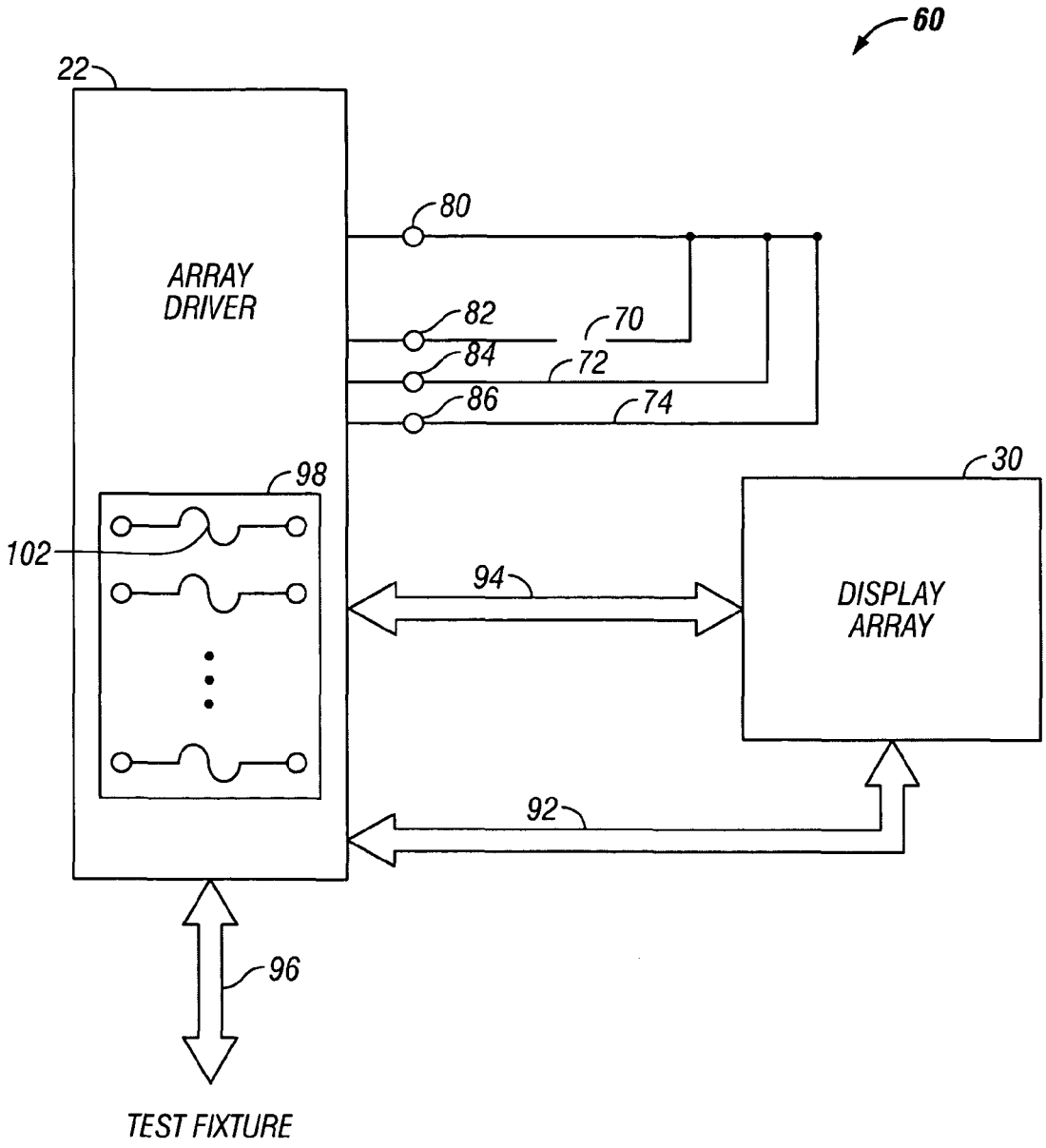
FIG. 12 is a schematic block diagram illustrating one embodiment of an electronic device comprising an array driver connected to the display panel in FIG. 11.

FIG. 12 is a schematic block diagram illustrating one embodiment of an electronic device comprising an array driver connected to the display panel in FIG. 11. As discussed above, the circuit 22 stores information related to the display array 30. In the exemplary embodiment, the circuit 22 stores a panel identification number representing the type of the display array 30. The array driver 22 is as described above with regard to FIGS. 2 and 6B. The array driver 22 connects to the display array 30 to provide row and column driving signals 92 and 94. The array driver 22 is also connected to the circuit 60 via the contact pads 80, 82, 84, and 86.

In certain embodiments, the array driver 22 is designed to be compatible with more than one type of display arrays. The array driver 22 comprises certain variable parameters. After the array driver is mounted to a display array, these parameters will be adjusted based on the type of the display array such that the array driver can reliably drive the display array. The adjustment to these parameters may or may not be permanent. In the exemplary embodiment, the array driver 22 comprises a configurable circuit 102, the circuit comprising a collection of blowable fuses 102. By selectively blowing certain blowable fuses, parameters of the array can be adjusted.

In certain embodiments, the array driver 22 further stores information about itself, such as an array driver identification number, in a circuit or by other means. Such information can be read by an electronic device such as a test fixture connected to the array driver. In one embodiment, such information is stored by a circuit similar to the circuit 60.

In order to configure the parameters in the array driver 22 based on the type of the display array 30, a test fixture may be connected to the array driver via an input/output interface 96. The test fixture can be any electronic device suitable for configuring and testing circuit or device. The test fixture may or may not be automated. In one example, the text fixture may include a computer executing one or more software modules. Since the array driver 22 is connected to the circuit 60, the test fixture can communicate with the circuit 60 via the array driver 22.

The test fixture first reads the panel identification number stored in the circuit 60. As discussed above with regard to FIG. 8, the test may cause the array driver to apply a voltage signal, such as +5 volts, to the common contact pad 80 and read the signal at the contact pads 82, 84, and 86 to detect the open circuit and closed circuit state of the links 70, 72, and 74. The test fixture then reads the array driver identification number from the array driver 22.

Both the array driver identification number and the panel identification number are in a list of pre-defined identification numbers to which the test fixture has access. For example, a list of pre-defined identification numbers may be stored at the test fixture. The test fixture then determines whether the array driver 22 is compatible with the display array 30 based on the panel identification number and the array driver identification number. If the test fixture determines that they are not compatible, it will issue a warning that an assembly error is detected.

In case the test fixture determines that the array driver 22 and the display array 30 are compatible, the test fixture then determines a set of parameters corresponding to the retrieved panel identification number. The test fixture then controls the array driver 22 to selectively blow certain blowable fuses in the configurable circuit 98 such that the set of parameters desired is loaded into the array driver 22.

Figure 13:
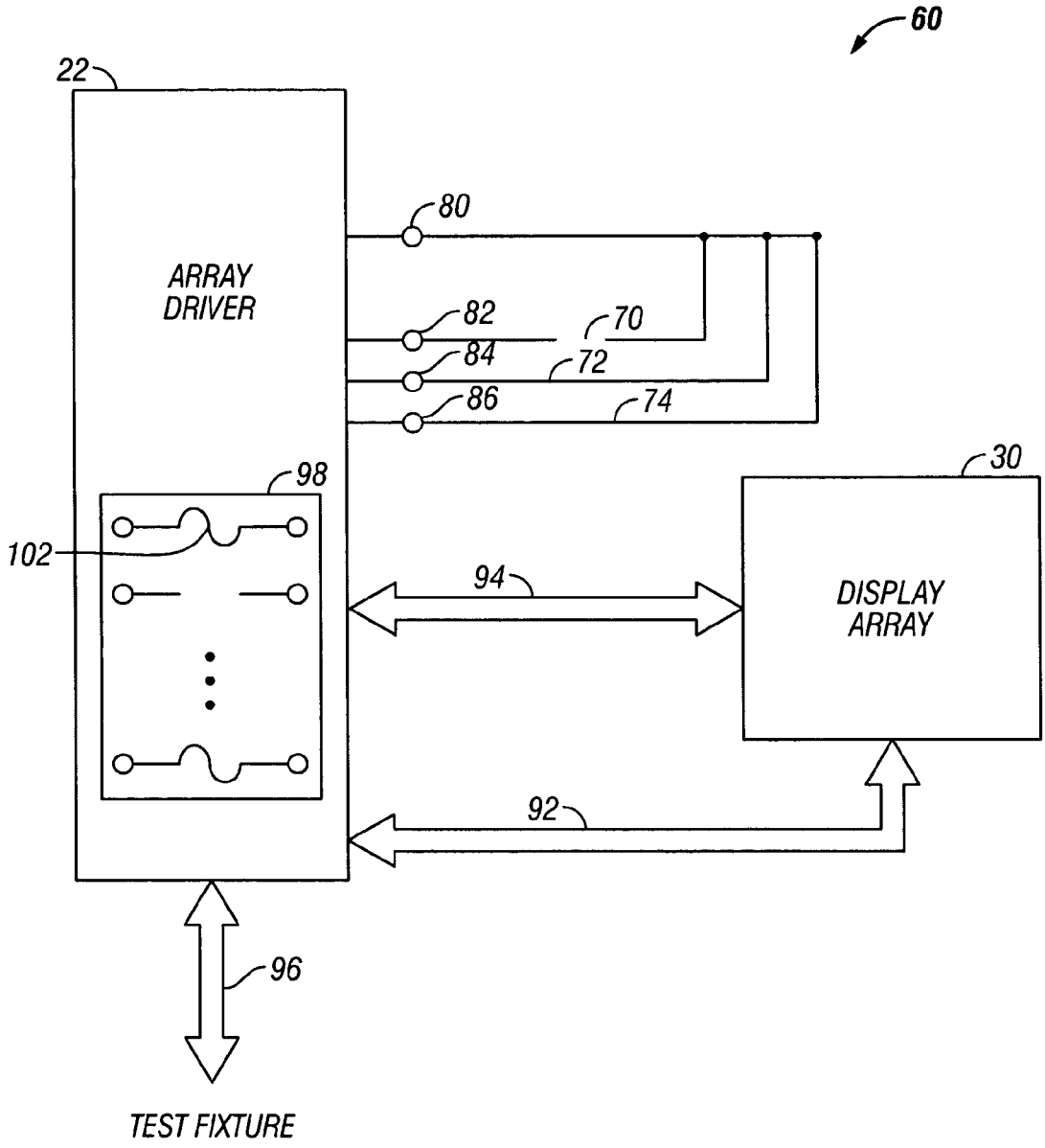
FIG. 13 is a schematic block diagram illustrating one embodiment of an electronic device comprising an array driver connected to the display panel in FIG. 11.

FIG. 13 is a schematic block diagram illustrating one embodiment of an electronic device comprising an array driver connected to the display panel in FIG. 11. In FIG. 13, the array driver 22 is loaded with a set of parameters suitable for driving the display array 30. Certain blowable fuses of the configurable circuit 98 are blown, after the information encoding conducted by the test fixture (see FIG. 11).

Figure 14:
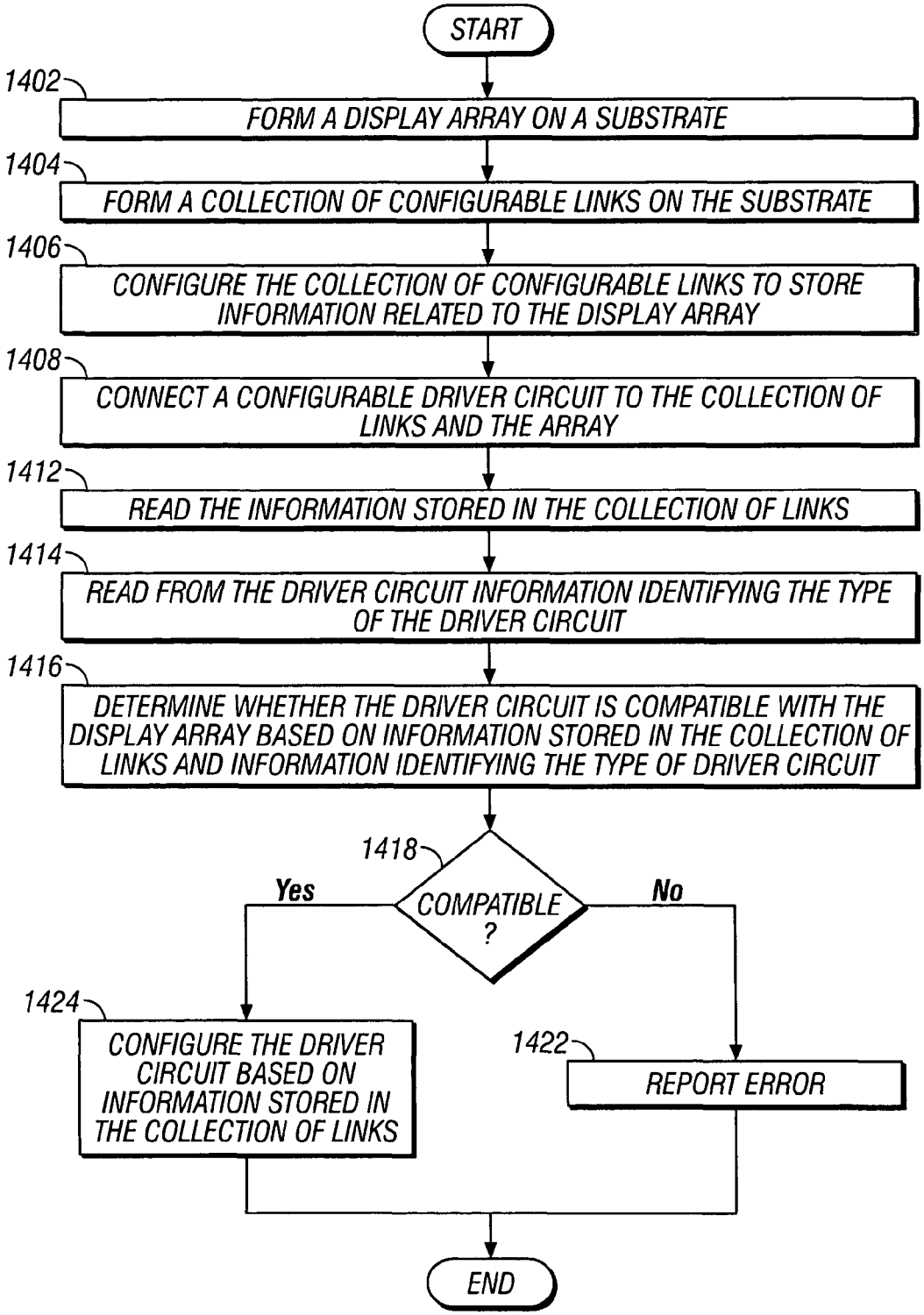
FIG. 14 is a flowchart illustrating one embodiment of a method of making a display device comprising a display array and an array driver.

FIG. 14 is a flowchart illustrating one embodiment of a method of making a display device comprising a display array and an array driver. Depending on the embodiment, certain steps of the method may be removed, merged together, or rearranged in order. One feature of the exemplary method is that it automates the programming of a large set of configurable parameters through a small number of read-only bits stored on a display panel.

The method starts at a block 1402, where a display array 30 is formed on a substrate. Next at a block 1404, a circuit 60 comprising a collection of configurable links is formed on the substrate, as described above. In one embodiment, each configurable link comprises a blowable fuse. In another embodiment, each configurable links comprises a single continuous conductive metal line.

Moving to a block 1406, the collection of links of the circuit 60 is configured to store information related to the display array 30. In case each configurable link comprises a blowable fuse, the circuit 60 is configured by selectively blowing certain blowable fuses based on the information to be stored. In case each configurable links comprises a single continuous conductive metal line, the circuit 60 is configured by selective separating or cutting certain metal lines. In the exemplary embodiment, the information forms a panel identification number which defines a set of display parameters indirectly.

Next at a block 1408, a configurable array driver 22 is connected to the collection of links of the circuit 60 and the display array 30 as described in FIG. 12. A test fixture is also connected to the configurable array driver 22. Moving to a block 1412, the test fixture reads the information stored in the collection of links of the circuit 60 as described in FIG. 12. In the exemplary embodiment, the information is the panel identification number of the display array 30.

Next at a block 1414, the test fixture reads from the driver circuit information identifying the type of the driver circuit, i.e., the array driver 22. In the exemplary embodiment, the information is an array driver identification number. Moving to a block 1416, the text fixture determines whether the driver circuit, e.g. the array driver 22, is compatible with the display array 30, based on the information stored in the collection of links and information identifying the type of the driver circuit. The method moves to a block 1422 if the test fixture determines that the array driver 22 is not compatible with the display array 30. At a block 1422, the test fixture reports an assembly error.

The method moves to a block 1424 if the text fixture determines that the array driver 22 is compatible with the display array 30. At block 1424, the test fixture configures the driver circuit (the array driver 22) based on the information read from the collection of links of the circuit 60, as described in FIG. 12. In the exemplary embodiment, the array driver 22 comprises a configurable circuit 102, the circuit comprising a collection of blowable fuses 102. The test fixture determines a set of parameters corresponding to the retrieved panel identification number. The test fixture then controls the array driver 22 to selectively blow certain blowable fuses in the configurable circuit 98 such that the set of parameters desired is permanently loaded into the array driver 22. In another embodiment, the information retrieved from the collection of links may comprise a set of parameters ready to be loaded into the array driver 22.

In certain embodiments, block 1404 may be removed. For example, a circuit 60 comprising a collection of links, wherein each link is initially formed as a single and continuous line or a broken line segment, depending on the information to be stored. Also, in certain embodiments, blocks 1416, 1418, and 1422 may be removed when the compatibility between the array driver 22 and the display array 30 is not at concern.

The foregoing description details certain embodiments of the invention. It will be appreciated, however, that no matter how detailed the foregoing appears in text, the invention can be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated.

What is claimed is:

1. A method of storing information related to a display array formed on a substrate, the method comprising:

forming a collection of links on the periphery of a display array on the substrate to store information related to said display array, wherein said information is encoded by forming each link as a broken or continuous metal line between a first end and a second end of the link so as to form either an open circuit or a closed circuit between the first and second end;

connecting an array driver to the display array and the collection of links, the array driver comprising at least one blowable fuse; and setting the at least one blowable fuse to form either an open circuit or closed circuit between a first end and a second end of the blowable fuse based at least in part on information read from the collection of links, wherein the array driver drives the display array based at least in part on the setting of the blowable fuse.

2. The method of claim 1, wherein the information is stored in the collection of links and is readable by detecting whether each link forms an open circuit or closed circuit between two ends of the link.

3. The method of claim 1, wherein the information comprises the type of the display array.

4. The method of claim 1, wherein the information comprises drive parameters for an array driver coupled to the display array.

5. The method of claim 1, wherein each link comprises a highly conductive metal line.

6. The method of claim 1, wherein the forming further comprises:

forming a collection of blowable fuses, each blowable fuse comprising a blowable fuse connecting the two ends of the link; and selectively blowing the blowable fuse of a subset of blowable fuses.

7. The method of claim 1, wherein the forming further comprises:

forming a collection of highly conductive metal lines; and selectively breaking a subset of the collection of metal lines.

8. The method of claim 1, wherein the collection of links is not a part of the array driver.

* * * * *